United States Patent [19]

Hartness et al.

[11] 3,986,321

[45] Oct. 19, 1976

[54] CONTROL APPARATUS FOR ARTICLE LOADING MACHINE

[76] Inventors: Thomas P. Hartness, 305 Bridgewater Drive; Robert G. Hartness, 203 Wilmington Road, both of Greenville, S.C. 29607

[22] Filed: Dec. 4, 1975

[21] Appl. No.: 637,530

[52] U.S. Cl. ..... 53/64; 53/55

[51] Int. Cl.[2] ..... B65B 57/02

[58] Field of Search ..... 53/64, 67, 69, 70, 71, 53/55

[56] References Cited

UNITED STATES PATENTS

| | | | |
|---|---|---|---|
| 2,819,576 | 1/1958 | Hendricks et al. | 53/55 X |
| 3,421,283 | 1/1969 | Schieser | 53/55 |

*Primary Examiner*—Travis S. McGehee

*Attorney, Agent, or Firm*—Bailey, Dority & Flint

[57] ABSTRACT

A control apparatus is provided for properly positioning an empty case on an elevator platform of an article loading machine having a conveyor for moving the empty case onto the elevator platform to be raised thereby to a loading position beneath a loading mechanism, a clutch and brake arrangement for intermittently controlling the conveyor, and hydraulic or pneumatic means for raising and lowering the elevator wherein the control apparatus comprises a cam means having a first position abutting a front end of the case when transported onto the elevator platform for physically stopping the case and for sequentially deactuating the clutch, and actuating the brake for stopping the conveyor and for actuating the hydraulic means for raising the elevator platform. The cam means has a second position below a bottom surface of the case when loaded and lowered to an original position for actuating the means for starting the conveyor while providing a roller surface over which the loaded case is moved. The control apparatus thus provides proper alignment and positioning of the case on the elevator platform to prevent mis-loading of articles in the case and malfunctioning of the loading machine when the case is raised to the loading position.

16 Claims, 5 Drawing Figures

CONTROL APPARATUS FOR ARTICLE LOADING MACHINE

BACKGROUND OF THE INVENTION

In article loading machines such as the bottle loading machine shown in applicant's U.S. Pat. No. 3,788,034 it is necessary to convey an empty case onto an elevator platform which raises the empty case immediately beneath a grid set having downwardly extending rigid fingers for directing the bottles into the empty case. Thereafter, the case is lowered and conveyed away from the elevator platform. Another empty case is then conveyed onto the elevator platform and the cycle is repeated. Such a cyclic operation is used on many conventional bottle loading machines which must employ some type of control apparatus to control the conveyancing and sequencing of the empty cases onto the elevator platform, raising and lowering of the platform, and removal of the case after loading.

The key to the successful operation of such an article loading machine is in the correct positioning of the empty case on the elevator platform so that the rigid fingers and the compartments in the empty case are perfectly aligned so as to enable the bottles to fall through the grid set into the case properly. If the case is positioned improperly on the platform, the case and grid set will be out of alignment causing bottles to be mis-loaded in the case further causing the loading machine to malfunction or possibly causing the bottles to fall out of the case onto the elevator platform or floor. A machine attendant must therefore be provided to correct the improper positioning of the case on the platform and any resulting malfunction of the bottle loading machine. Thus, the necessity of accurately positioning the empty case on the elevator platform can be seen to ensure continuing cyclic operation of the article loading machine.

One problem with the control devices of the prior art is that when the in-feed conveyor which transports the empty cases onto the platform is stopped, the inertia of the case causes it to drift on the platform and its position on the elevator platform cannot be accurately predetermined. An attempted solution to this problem has been to move the side rail members alongside the platform closer together so as to provide friction against the empty case thereby reducing its tendency to drift. However, such a solution is not very practical due to the use of many sizes of cases and the continual adjusting of the spacing between the side rail members.

Other prior article loading machines have used a continuously moving feed conveyor which comprises a flight bar extending across the conveyor which pushes the empty case onto the elevator platform and then continues downwardly past the platform to trip a switch to effect raising of the elevator platform. However, the problem with such a system is that the article loading machine has no way of knowing whether or not an empty case is sitting on the elevator platform. If for some reason an empty space existed on the conveyor and a case was not conveyed onto the elevator platform by the flight bar, the flight bar would still proceed downwardly to the switch causing the elevator platform to be raised beneath the grid set resulting in the glass bottles being dropped onto an empty elevator. Such an event happens quickly and if the machine operator is not watching at the moment the empty bottles can be broken over the floor causing a costly delay and interruption in the operation of the machine. Hence, such a system will operate whether or not a case is on the elevator platform during the operational cycle.

SUMMARY OF THE INVENTION

A control apparatus is provided for properly positioning a case on an elevator platform in an article loading machine having a conveyor for transporting the case onto the elevator platform, means for stopping and starting the conveyor, and means for raising the elevator platform and case to a position for loading articles into the case. Means are also provided for lowering the elevator platform and case in response to the case being loaded with articles, and means for moving the loaded case off of the elevator platform and bring another empty case on to the elevator to be filled.

The control apparatus comprises a cam means having a first position abutting a front end of the case when transported onto the elevator platform for physically stopping the case and for sequentially actuating the means for stopping the conveyor and the means for raising the elevator platform. The cam means has a second position below a bottom surface of the case when loaded and lowered to an original position for actuating the means for starting the conveyor. The control apparatus thus provides proper alignment and positioning of the case on the elevator platform to prevent mis-loading of articles in the case and malfunctioning of the loading machine when the case is raised to the loading position.

Accordingly, an important object of the present invention is to provide a control apparatus for properly aligning and positioning a case on an article loading machine to prevent mis-loading of articles into the case.

Another important object of the present invention is to provide a control apparatus having a single control member for controlling the operations of the article loading machine and wherein none of the control apparatus is carried on the elevator platform itself.

Another important object of the present invention is to provide a control apparatus for accurately positioning a case on an article loading machine and for providing a positive physical stop to the case member when transported onto the elevator platform.

Another important object of the present invention is to provide a roller member as part of the control apparatus which reduces the friction and enables the loaded case to be moved off the elevator platform without having special conveying apparatus on the out-feed end of the machine.

Another important object of the present invention is to provide a control apparatus for properly positioning cases on an article loading machine that will not go through the operational timing sequences unless there is a case physically present on the elevator platform.

Still another important object of the present invention is to provide a control apparatus for properly positioning a case on an article loading machine in a highly accurate manner so as to virtually eliminate mis-loading of articles into the case and the need to have a machine operator in close attendance.

The construction designed to carry out the invention will be hereinafter described, together with other features thereof.

The invention will be more readily understood from a reading of the following specification and by reference to the accompanying drawings forming a part thereof, wherein an example of the invention is shown and wherein:

DESCRIPTION OF A PREFERRED EMBODIMENT

Figure 1:
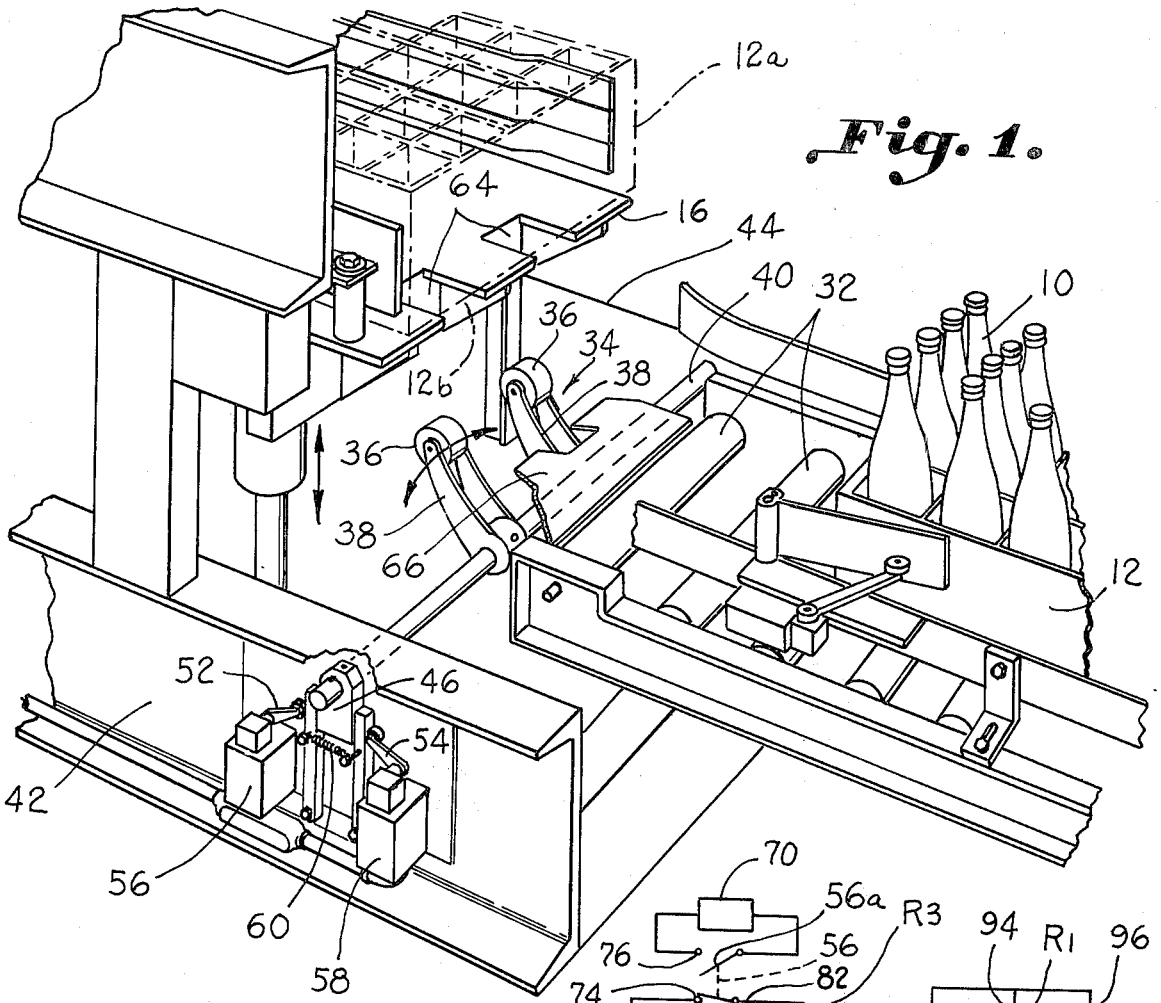
FIG. 1 is a perspective view illustrating a control apparatus constructed in accordance with the present invention as used on an article loading machine with parts of the loading machine omitted.

The apparatus of the present invention may be incorporated in any conventional article loading machine, such as the bottle loading machine shown in applicant's U.S. Pat. No. 3,788,034 to properly position an empty case on the loading machine. Since such machines are well known in the art, it will be unnecessary to disclose or describe a complete article loading machine herein. Accordingly, the drawings show only so much of a conventional article loading machine as is necessary to illustrate the application thereto of the present invention.

Referring now to the drawings, an article loading machine is shown for loading bottles 10 into empty cases 12 having an in-feed conveyor member 14 for transporting the empty cases onto an elevator platform 16. The conveyor member 14 may be any suitable conveyor member, usually driven by an electric motor, such as shown in U.S. Pat. No. 2,713,488. In a preferred embodiment, the conveyor member comprises a chain 14 which carries a plurality of spaced dog members 18 which engage a back portion of the case 12 transporting the case along the conveyor path. A single case 12 is carried between each dog member 18. The dog member 18 pushes the case 12 onto the elevator platform 16. After the case is loaded, the conveyeor 14 is restarted and the dog member 18 passes through a cut-out portion in the platform (not shown) to push the case off of the platform. A conventional electric clutch C is utilized to intermittently drive the conveyor 14 and a conventional electric brake B is utilized to positively stop the conveyor 14 when the clutch is disengaged.

The elevator platform 16 is raised and lowered by a conventional air cylinder 20 which is controlled by a conventional air valve for supplying and exhausting air to the cylinder as, for example, shown in U.S. Pat. No. 2,713,488. A rod member 22 is attached to the elevator platform 16 at one end and is attached at the opposite end to a piston in the air cylinder 20 in a conventional manner to raise and lower the elevator platform accordingly. A guide rod 24 is carried by the article loading machine over which a guide bushing 26 slides, the guide bushing being attached to the elevator platforms 16 to provide stability to the platform during raising and lowering operations.

Figure 3:
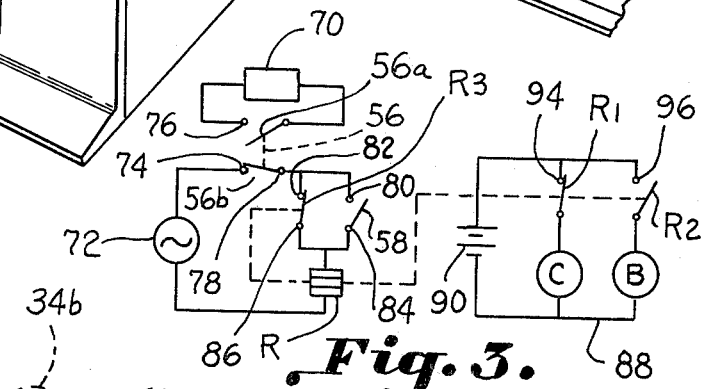
FIG. 3 is a schematic diagram illustrating an electrical control circuit which is actuated by the control apparatus constructed in accordance with the present invention for controlling the operation of the article loading machine.

An electrical control circuit, shown in FIG. 3, is provided to control the intermittent operation of the conveyor member 14 and to control the operation of the elevator platform to provide the proper timing for the operational cycle of the article loading machine. The electrical control circuit is, in turn, controlled by the control apparatus of the present invention, as will be fully explained later, to provide the proper cycle timing and positioning of cases on the elevator platform 16.

The article loading machine has a grid set 28 including a plurality of fingers 30 depending downwardly therefrom through which the bottles 10 pass for loading into the empty case 12. The fingers 30 may be constructed of any suitable material and may either be flexible or rigid. The case 12 is raised to a loading position by the elevator platform 16 and thereafter is lowered to its original position to be moved off of the platform and transported away therefrom by the roller members 32 which are rotatably driven by a conventional chain and electric motor arrangement. It is important to the efficient operation of the article loading machine that the empty case 12 be positioned accurately on the elevator platform before being raised to the loading position to ensure that the case is in proper alignment with the grid set 28 and fingers 30.

Figure 2:
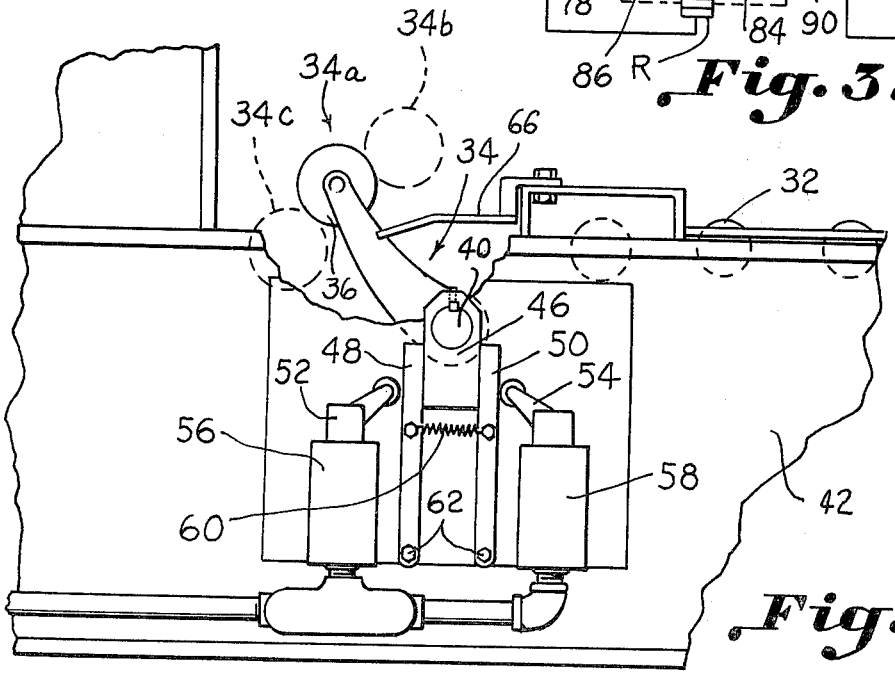
FIG. 2 is a side elevational view illustrating a control apparatus and switch apparatus constructed in accordance with the present invention as used on an article loading machine with parts omitted.

To provide accurate and proper positioning of the cases 12 on the elevator platform, a control apparatus constructed in accordance with the present invention is provided. The control apparatus comprises a cam means, designated generally at 34, which engages the front end **12*a* of the case 12 in a first position and engages a bottom surface 12*b* of the case in a second position to control the operation of the in-feed conveyor and elevator platform as will be more fully explained later. The cam means includes a roller member 36 rotatably carried by a cam arm member 38. The cam arm member 38 is fixed on a rotatable shaft 40 which extends transverse to the path of travel of the case and is rotatably carried by a pair of side frame members 42 and 44 of the loading machine. A cam lever 46 is carried on an end of the shaft 40 extending through the side frame member 42. The cam lever 46 is nested between a pair of bar members 48 and 50 which engage roller arm switches 52 and 54, respectively, to actuate switches 56 and 58, respectively. A resilient biasing force is provided by spring member 60 to hold the bar members 48 and 50 in contact with the cam lever 46 and to maintain the cam means 34 in a neutral position, 34*a*, as is best seen in FIG. 2. The bar members 48 and 50 are pivotably carried by the side frame member 42 by screw members 62. The cam means may be moved from the neutral position 34*a* to a backward, first position 34*b* or to a downward, second position 34*c* for actuating switches 56 and 58,** respectively.

In a preferred embodiment a pair of roller elements 36 and cam arm members 38 are carried by the shaft 40 and are spaced apart so as to evenly abut the front **12*a* of a case moving onto the elevator platform 16. A pair of cut-out portions 64 are provided in the elevator platform 16 so that the cam means 34 may rotate therethrough when moving between the neutral position 34*a* and the downward position 34*c*.**

Figure 4:
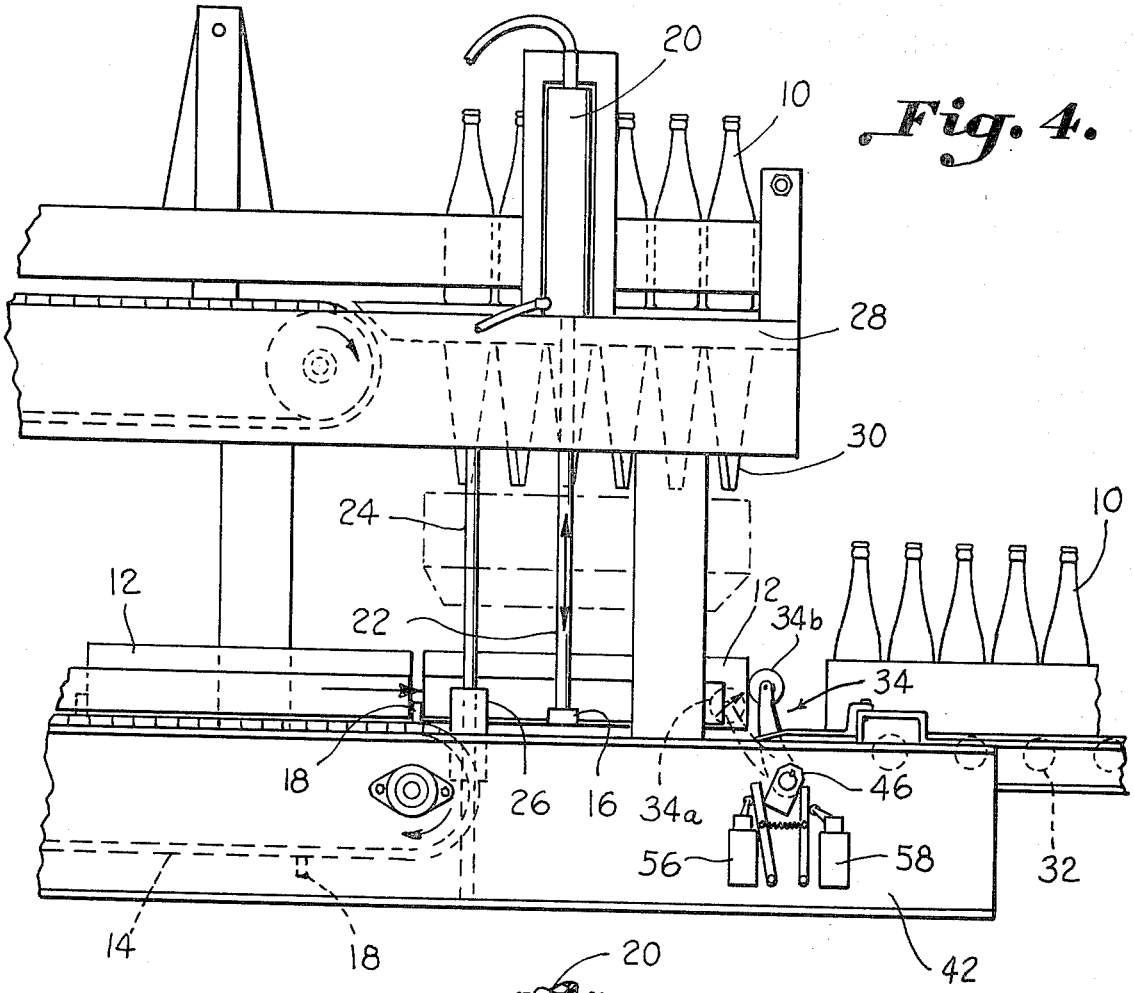
FIG. 4 is a side elevational view illustrating the operation of a control apparatus constructed in accordance invention when in a first position and the operation of the article loading machine.
Figure 5:
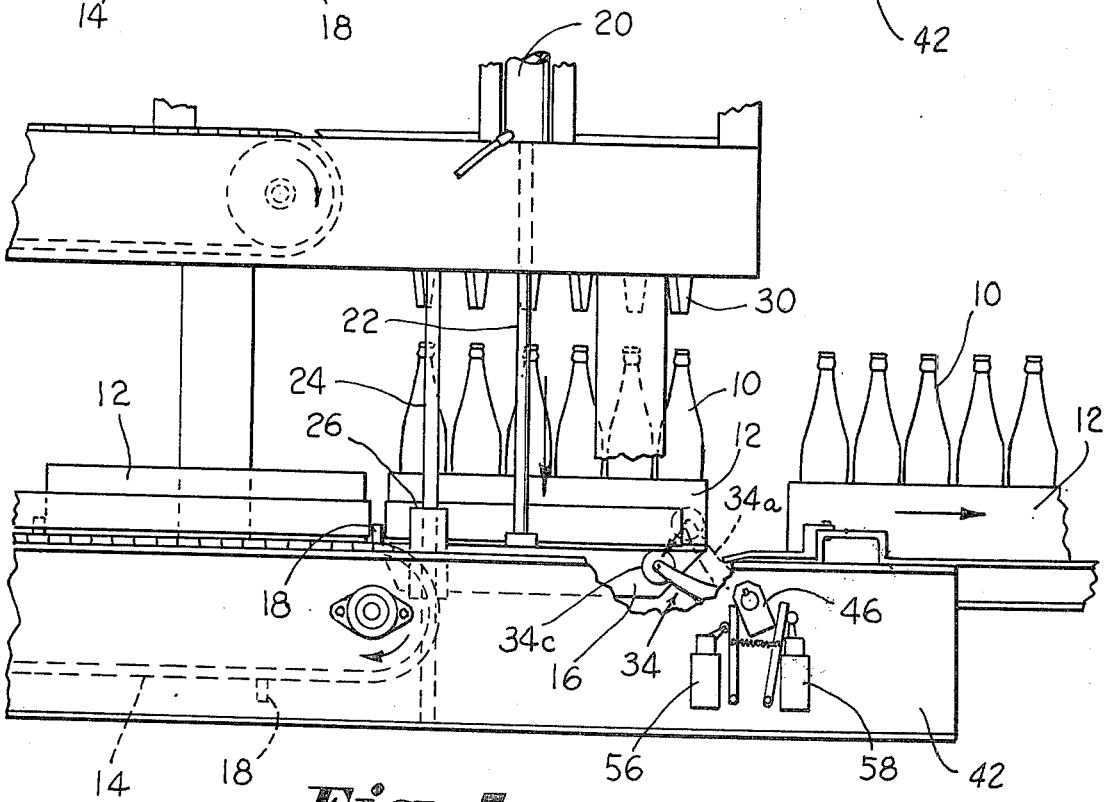
FIG. 5 is a side elevational view illustrating the operation of a control apparatus constructed in accordance with the present invention when in a second position and the operation of the loading machine.

The cam means 34 operates as follows, as best seen in FIGS. 4 and 5. As the cam means 34 abuts the front **12*a*** of an empty case 12 when being transported onto the elevator platform, it is moved to the first or backward position 34*b* actuating switch 56 stopping the in-feed conveyor and raising the elevator platform. As the elevator platform is raised and the case is moved out of contact with the cam means, the cam means 34 is allowed to return to its neutral position 34*a*. After the case 12 is loaded with bottles, the elevator platform is lowered and as it descends, the bottom surface 12*b* of the case 12 which covers the cut-out portion 64 in the elevator platform abuts the cam means 34 and moves the cam means to the second or downward position 34*c*, as is best seen in FIG. 5. In the second position, the cam means 34 actuates the switch 58 starting the in-feed conveyor and moving the loaded case off of the elevator platform to be transported away therefrom. As the loaded case 12 is moved off of the elevator platform, the roller members 36 provides a roller surface over which the case may roll reducing the friction and enabling the case to be moved off of the elevator platform without special conveying apparatus at the out-feed end of the loading machine. When the in-feed conveyor 14 starts up, the dog bar 18 will sufficiently move the loaded case off of the elevator platform over the roller elements 36, and over a guide plate 66 to enable the loaded case to be caught by the motorized rollers 32 and conveyed away from the elevator platform.

When in the first position 34*b*, the cam means 34*b*, the cam means 34 provides a positive physical stop for the case 12 coming onto the platform 16, and thus ensures accurate positioning of the case on the platform. The control apparatus is designed such that the switch 56 is actuated immediately prior to the case 12 reaching the physical stop provided by the cam means 34 providing coast time to the case 12 on the elevator platform and preventing any tendency of the case 12 to be squeezed out between the dog member 18 and the cam means 34 which might occur.

Referring now to FIG. 2, the cam means is normally maintained in the neutral position 34*a* by the resilient biasing means 60 and the neutral position 34*a* is intermediate the positions 34*b* and 34*c* shown by the dashed lines. The cam means 34 is in the second position 34*c* when abutting and below the bottom surface 12*b* of a loaded case after the case has been lowered from the loading position. After the loaded case is moved off of the elevator platform 16, the cam means 34 is returned to its neutral position 34*a* by the resilient biasing means 60 as it is permitted to pass through the cut-out portions 64. When the cam means 34 is in its first position 34*b* it is abutting the front end 12*a* of a case and removal of the case by raising the case to its loading position by the elevator platform will allow the cam means 34 to return under the force of the biasing means 60 to its neutral position. In the neutral position. In the neutral position 34a the cam means would be in the position to be engaged and abutted by the bottom surface 12*b* of a loaded case being lowered to its original position after loading. Thus, it can be seen, that the cam means is actuated by the case 12, itself, and there is no way that the control apparatus will operate without the case being physically present on the elevator platform 16. Therefore, the article loading machine cannot go through the operational cycle without a case on the elevator platform preventing the possibility of bottles being emptied out on an empty platform as often resulted in conventional bottle loading machines.

Referring now to FIG. 3, a schematic diagram is shown illustrating in schematic form a suitable electrical control circuit which can be used to stop and start the infeed conveyor 14 and to actuate the elevator control circuit 70. The control circuit has an AC power source 72 having one side connected to a contact terminal 74 of a double pole switch 56 and the other side of the AC power source is connected to one side of a relay switch R. A first contact arm 56*a* of the switch 56, having a contact terminal 76 is provided to actuate and energize the elevator control circuit 70 when the contact 56*a* is closed.

The terminal 78 of a second contact arm 56*b* of switch 56 is connected to terminal 80 of a switch 58 in series with relay R, and terminal 78 is also connected by terminal 82 to relay contact R3. Relay contact R3 is connected in shunt with switch 58 so that after the relay R has been energized by closing switch 58 it will remain energized upon opening of switch 58 since relay contact R3 remains closed until contact 56*b* is opened.

The relay R, which is shown in FIG. 3 in a normally energized condition, operates relay contacts R1 and R2 in a separate electrical circuit 88 for actuating an electrical clutch C to start the in-feed conveyor and for actuating an electrical brake B for stopping the in-feed conveyor. The electrical circuit 88 includes a DC power source 90 having one side connected to a contact terminal 94 of relay contact R1 and to contact terminal 96 of relay contact R2. Electrical clutch member C and electrical brake member B are connected in parallel with the DC power source and are energized through the closure of the relay contacts R1 and R2, respectively, to control the intermittent operation of the in-feed conveyor.

The elevator control circuit 70 may be a conventional control circuit used on many of the conventional bottle loading machines and is actuated by the momentarily closing of contact 56*a* of switch 56 when the cam means 34 is moved to its first position 34*b* by an empty case being moved onto the elevator platform. Actuation of the elevator control circuit 70 energizes an electrical solenoid air valve to admit air valve to admit air to the air cylinder 20 so as to raise the elevator platform. The elevator control circuit conventionally includes a timing circuit to de-actuate the solenoid air valve in response the lapse of a predetermined amount of time after the empty case is loaded with bottles to exhaust the air from the air cylinder 20 lowering the elevator platfrom to its original position in a controlled manner.

The operation of the electrical control circuit for controlling the in-feed conveyor and actuation of the elevator platform is as follows. When cam means 34 is moved to its first position 34*b* by an empty case 12 coming onto the elevator platform, the switch 56 is actuated thus opening contact 56b and closing contact 56*a* to de-energize the relay R and actuate the elevator control circuit 70, respectively. When the elevator control circuit 70 is actuated, the elevator platform will be raised to its loading position with the empty case supported thereon. When the relay R is de-energized, the relay contact R1 is opened causing the electrical clutch C to be de-actuated and the electrical relay contact R2 to be closed, thus actuating the electrical brake B positively stopping the in-feed conveyor. Also, when the relay R is deenergized, relay switch R3 is opened. As the elevator platform raises the case 12 to its loading position, the cam means will be allowed to return to its neutral position and switch 56 will be allowed to return to its original position with contact 56*b* closed and contact 56*a* opened. However, at this point the relay R will not be energized again since relay contact R3 and switch 58 are both open.

After the elevator control circuit 70 is de-actuated by the timing circuit in response to the bottles being loaded in the case 12, the elevator platform 16 is lowered to its original position and as it descends, it engages the cam means 34 in its neutral position and moves it to its second position 34*c*. With the cam means 34*c* in its second position, the switch 58 will be actuated and closed thereby energizing the relay R. With relay R again energized, relay switch R1 will close to engage the electrical clutch C and R2 will open to disengage the electrical brake B thus starting up the in-feed conveyor moving the loaded case off of the elevator platform by the movement of dog member 18 and moving onto the élevator platform another empty case 12. Also, with relay R energized, relay contact R3 will be closed so that when the cam means 34 returns to its neutral position and switch 58 again is opened, the relay R will remain energized and the in-feed conveyor will remain in motion until cam means 34 is again moved to its first position 34*b* by the next case 12 moving onto the elevator platform.

In this manner, the above operational cycle of the control apparatus is repeated with another empty case 12 moving onto the elevator platform. It is again noted that the cam means 34 is allowed to move from its second position 34c to its neutral position 34*a* by the removal of a loaded case which permits the cam arm members 38 and roller members 36 to pass through the cut-out portions 64 prior to another empty case being transported onto the elevator platform. By providing a positive physical stop for the empty case being moved onto the platform, the control apparatus ensures an accurate positioning of the case on the platform each time and there is no way that the loading machine will go through its loading operation without a case being physically present on the platform.

Thus, a control apparatus is provided for accurately and properly positioning an empty case on the elevator platform of an article loading machine so that when the case is raised to its loading position it is aligned with the grid set through which the articles are loaded. Accurate positioning is necessary to prevent mis-loading of the bottle through the grid set which often results in spilling of the articles being loaded, such as bottles, onto the elevator platform and the floor. The apparatus of the present invention provides a single control for all of the operations of the article loading machine as concerns feeding of the cases and virtually eliminates the requirement of having a machine operator in attendance at all time. The control apparatus also affords the unique advantage that the control apparatus will not operate unless a case is physically present on the elevator platform, and thus if for some reason a case is not sequentially delivered by the in-feed conveyor, the control apparatus will not send an electrical signal to cause the in-feed conveyor and elevator platform to go through their operational sequences.

Although the operation of the control apparatus of the present invention has been described and disclosed with an intermittently operated conveyor system, it is also possible to use the control apparatus with an article loading machine having a continuous type conveyor system. In a continuous conveyor system, the control apparatus could be utilized solely for properly positioning the case on the elevator platform and for controlling the up and down operation of the elevator platform. It is also contemplated that the cam means 34 may be used only to stop the case coming onto the elevator platform to properly position the case thereon and after loading of the case to provide a roller surface over which the loaded case may be moved. In such use, the cam means would not have a switching function and other feeler type switches could be used to control the conveyor and elevator.

While a preferred embodiment of the invention has been described using specific terms, such description is for illustrative purposes only, and it is to be understood that changes and variations may be made without departing from the spirit or scope of the following claims.

What is claimed is:

1. A control apparatus for properly positioning an empty case and for operation of an in-feed case conveyor member and an elevator platform on an article loading machine having a grid set through which the articles pass for loading into said empty case wherein said conveyor member transports the empty case onto the elevator platform which raises the empty case to immediately beneath the grid set for loading the articles into the case and thereafter lowers the loaded case to an original position, an electrical control circuit for intermittently actuating an electrical means for starting and stopping said in-feed conveyor, said control circuit further actuating an elevator control circuit for raising said elevator platform, means responsive to said raised position and to said empty case being loaded to de-actuate said elevator control circuit, and means for moving the loaded case off of the elevator platform; said control apparatus comprising:

a. a first switch means connected in said control circuit being actuated to positively stop said in-feed conveyor member and for actuating said elevator control circuit;

b. a second switch means connected in said control circuit being actuated to start said in-feed conveyor member, said conveyor member thereafter moving said loaded case off of said elevator platform while transporting another said empty case onto said elevator platform;

c. cam means carried adjacent said elevator platform transverse to the path of said conveyor member having a first position abutting the front end of said empty case when transported onto said elevator platform, said cam means actuating said first switch means when in said first position;

d. said cam means having a second position below said loaded case when lowered to said original position after loading, said cam means actuating said second switch means when in said second position.

2. The apparatus of claim 1 wherein said cam means is normally maintained in a neutral position between said first and second positions, said first and second switches remaining in a non-actuated position when said cam means is positioned in said neutral position, said cam means returning to said neutral position immediately after said loaded case is moved off of said elevator platform and prior to another said empty case being transported onto said elevator platform.

3. The apparatus of claim 1 wherein;

a. said cam means includes at least one roller member carried by a rotatable shaft extending transverse to the path of said conveyor member rotatably carried between a pair of side frame members of said article loading machine; and b. a cut-out portion is provided in said elevator platform for receiving said roller member passing therethrough as said shaft rotates, said cut-out portion being substantially covered by a bottom surface of said loaded case supported on said elevator platform when being lowered to said original position;

whereby said bottom surface of said loaded case covering said cut-out portion abuts said roller member forcing it downwardly to said second position as said loaded case is lowered.

4. The apparatus of claim 3 wherein said cam means further includes resilient biasing means for returning said cam means to said neutral position following the removal of said loaded case from said elevator platform permitting passage of said roller member through said cut-out portion, and for returning said cam means to said neutral position from said first position following removal of said empty case from abutment with said cam means by raising said empty case on said elevator platform.

5. For use in properly positioning a case on an elevator platform in an article loading machine having a conveyor for transporting the case onto said elevator platform, means for starting and stopping said conveyor, means for raising said elevator platform and said case to a position for loading articles into said case, means for lowering said elevator platform and case to an original position in response to said case being loaded with articles, and means for moving said loaded case off of said elevator platform; a control apparatus comprising:

cam means having a first position abutting a front end of said case transported onto said elevator platform for stopping said case on said elevator platform and for sequentially actuating said means for stopping said conveyor and said means for raising said elevator platform; and said cam means having a second position below a bottom surface of said loaded case when lowered to said original position for actuating said means for starting said conveyor;

whereby said control apparatus provides proper alignment and positioning of said case on said elevator platform to prevent mis-loading of articles in said case and malfunctioning of said loading machine when said case is raised to said loading position.

6. The apparatus of claim 5 wherein said cam means is carried by said article loading machine across the path of travel of said case, said cam means having a neutral position intermediate said first and second positions when out of contact with said case.

7. The apparatus of claim 6 wherein a cut-out portion is provided in said elevator platform permitting passage of said cam means therethrough when being returned to said neutral position from said second position.

8. The apparatus of claim 7 wherein said bottom surface of said loaded case covers said cut-out portion and abuts said cam means in said neutral position to move said cam means to said second position as said loaded case is lowered to said original position.

9. The apparatus of claim 5 wherein said cam means includes a roller member over which said loaded case rolls when being moved off of said elevator platform by said in-feed conveyor member after said loaded case is lowered to said original position and said cam means is in said second position.

10. The apparatus of claim 7 wherein said cam means includes a resilient biasing means for returning said cam means to said neutral position when released from said second position by removal of said loaded case.

11. The apparatus of claim 6 wherein said cam means comprises:

a shaft means extending transverse to said path of travel of said case rotatably carried by a pair of side frame members of said article loading machine;

a cam arm member carried by said shaft means for rotation therewith; and a roller member rotatably carried by said cam arm member.

12. The apparatus of claim 6 wherein said cam means includes a resilient biasing means for maintaining said cam means in said neutral position returning said cam means to said neutral position when released from either said first position or said second position by removing said case from contract with said cam means.

13. A control apparatus for properly positioning an empty case on an elevator platform of an article loading machine having a conveyor for moving the case onto the platform, means for raising the elevator platform and empty case from an original position to a loading position beneath a loading mechanism, means for lowering the elevator platform to said original position in response to said empty case being loaded with articles, and means for moving said loaded case off of the elevator platform; said control apparatus comprising:

cam means carried by said article loading machine abutting a front end of said empty case moving onto said elevator platform;

said cam means being moved by said case to a backward position providing a physical stop for said empty case to properly position said empty case on said elevator platform; and switch means responsive to said empty case being moved onto said elevator platform for actuating said means for raising said elevator platform;

whereby said case is properly positioned on said elevator platform so as to be in accurate alignment with said loading mechanism when raised to said loading position.

14. The apparatus of claim 13 wherein said cam means actuates said switch means when moved to said backward position.

15. A control apparatus for properly positioning an empty case on an elevator platform of an article loading machine having a conveyor for moving the case onto the platform, means for raising the elevator platform and empty case from an original position to a loading position beneath a loading mechanism, means for lowering the elevator platform to said original position in response to said empty case being loaded with articles, and means for moving said loaded case off of the elevator platform; said control apparatus comprising:

movable cam means carried adjacent said elevator platform in the path of travel of said empty case, said cam menas being normally maintained in a neutral position;

said cam means being engaged in said neutral position by said empty case moving onto said platform and being moved thereby to a first position for stopping and properly positioning said case on said platform;

biasing means for returning said cam means from said first position to said neutral position after said case is raised to said loading position;

said cam means being engaged in said neutral position by said loaded case during lowering thereof and being moved thereby to a second position below said loaded case when returned to said original position; and said biasing means returning said cam means from said second position to said neutral position after said loaded case is moved off of said platform.

16. The apparatus of claim 15 wherein said cam means includes a roller surface over which said loaded case rolls when being moved off of said platform after said cam means is moved to said second position.

* * * * *